US006745524B1

(12) United States Patent
Weinberg

(10) Patent No.: US 6,745,524 B1
(45) Date of Patent: Jun. 8, 2004

(54) METHOD AND APPARATUS FOR SUPPORTING A RAISED FLOOR AND A TOOL

(75) Inventor: Lane Weinberg, Portland, OR (US)

(73) Assignee: CH2M Hill Industrial Design & Construction, Inc., Portland, OR (US)

( * ) Notice: Subject to any disclaimer, the term of this patent is extended or adjusted under 35 U.S.C. 154(b) by 194 days.

(21) Appl. No.: 10/044,211

(22) Filed: Nov. 19, 2001

(51) Int. Cl.[7] ..... E04C 2/52
(52) U.S. Cl. ..... 52/220.1; 52/263; 248/121
(58) Field of Search ..... 248/121, 146, 248/176.1; 52/126.6, 220.1, 263, 299

(56) References Cited

U.S. PATENT DOCUMENTS 4,676,036 A * 6/1987 Bessert ..... 52/126.6
4,685,258 A * 8/1987 Av-Zuk ..... 52/126.6
5,678,375 A * 10/1997 Juola ..... 52/655.1
6,508,037 B1 * 1/2003 Owen ..... 52/220.1

* cited by examiner

*Primary Examiner*—Ramon O Ramirez
(74) *Attorney, Agent, or Firm*—Innovation Partners; Charles E. Gotlieb

(57) ABSTRACT

A support and method supports a tool and a raised floor using a single integrated support. The portion of the support supporting the raised floor may have an adjustable height, allowing the portion to be adjusted to the height and optionally the angle of the raised floor.

11 Claims, 2 Drawing Sheets

METHOD AND APPARATUS FOR SUPPORTING A RAISED FLOOR AND A TOOL

FIELD OF THE INVENTION

The present invention is related to industrial architecture and more specifically to support systems for tools and flooring in industrial cleanrooms.

BACKGROUND OF THE INVENTION

Conventional industrial cleanrooms are used to house tools for semiconductor processing, pharmaceutical manufacturing, biotechnology product manufacturing, food processing and for other industrial uses. Within the cleanroom, a modular floor raised above a subfloor is used to easily allow services including electrical service and gases or liquids to be brought to tools used for the processing operation of the cleanroom or a related operation such as cleaning portions of other tools. Raised modular floors also provide ease of reconfiguration of the cleanroom.

Conventional raised modular floors have a limit on the weight they can support. The limit is the lesser of the limit of the material used for the flooring itself and the support members used to raise the modular floor, although both limits may be nearly the same or identical. If a tool to be placed on the raised floor exceeds the lower of these weight limits, the tool can break through the floor, or may simply bend the supports or flooring tiles, or may compress the flooring tiles, which are corrugated like cardboard and therefore subject to compression.

To avoid this problem, such a tool is not placed on the floor. Although the tool could be placed on the floor and the supports for that section of the floor could be increased, the fact that the tool could compress the corrugated floor would make it difficult to level the tool to the tolerances some tools require. Instead, the floor tiles are removed and some are possibly cut to leave a hole in the floor slightly smaller than the footprint of the tool. The tool is then supported by means of tripods or other supports that come into direct contact with the subfloor of the cleanroom. Because the raised floor around the cutout must be supported, a frame is built between the raised floor and the subfloor, just outside the perimeter of the hole in the raised floor. Additional floor supports may be used to provide additional support for the raised subfloor near the hole.

However, there are several problems with this approach. The frame and additional supports are costly to install. Furthermore, they impede access to the area under the tool, impeding the running of services to the tool or making them more difficult to install. The frame could be replaced by a separate set of supports for the raised floor, but these new supports combined with the supports required for the tool could together impede running of services to the tool.

Some tools are supplied with a ledger plate that can be bolted to the supports for these heavy tools and support the floor around the hole, eliminating the need for flooring or other supports. The ledger plate is a piece of angle iron which is a flat piece of metal (it need not be iron) bent in the shape of an 'L '. To ensure that the floor supported in this fashion is highly level, and thereby avoid hazards to operators walking nearby the tool, these ledger plates are custom attached on site, either by drilling the ledger plate and support to allow precise bolting or by welding the ledger plate onto the support.

Although this arrangement solves the access problem of the frame, there are problems with this approach as well. The processes performed in cleanrooms are extremely sensitive to even the smallest amount of contamination. Thus, expensive containment procedures must be followed to install the ledger plates to the supports using the above procedures. In the event of an error, significant contamination from the drilling or welding processes may be introduced into the cleanroom, potentially contaminating several batches of materials in process and requiring an expensive and time consuming cleanup, during which time a portion of the cleanroom must be removed from service, adding additional expense to the process.

What is needed is a method and system for supporting a raised floor near a tool without requiring a frame and without drilling or welding the tool support.

SUMMARY OF INVENTION

A system and method supports at least a portion of a raised floor and at least a portion of a tool by adjusting a portion supporting the floor, and this portion may then be locked into place. A product may be produced using the tool.

DETAILED DESCRIPTION OF A PREFERRED EMBODIMENT

Figure 1A:
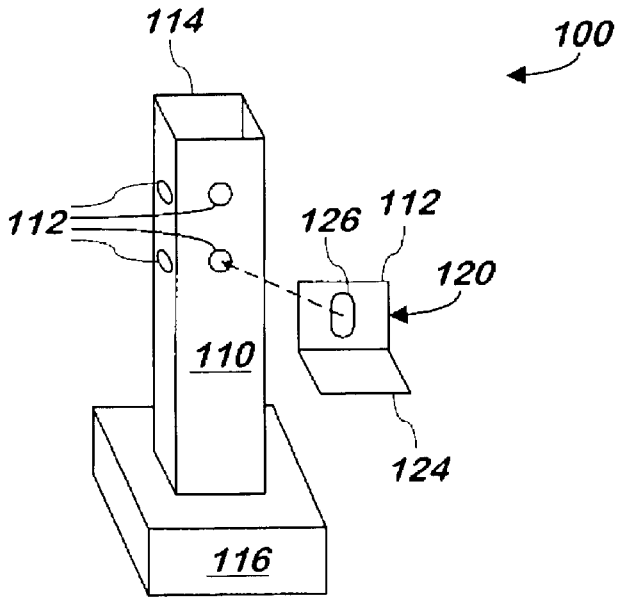
FIG. 1A is a block diagram of a support according to one embodiment of the present invention.

Referring now to FIG. 1A, a support 100 for supporting a tool and a raised floor is shown according to one embodiment of the present invention. Support 100 includes three components: a first component 114 for supporting the tool, a second component 120 for supporting a raised floor and a third component 110 that is coupled to the first component 114 and second component 120 and whereby at least one of the second component 120 and third component 110 include an adjustable attachment structure allowing at least an initial position adjustment of the second component relative to the first component. These components will now be described with reference to representative embodiments.

The third component, support member 110 is a conventional support member such as a channel made from steel, iron, plastic or any other material capable of supporting the expected load provided to support member 110 from the portion of the tool and the floor support member 110 will be supporting. Support member 110 may have a square cross section in one embodiment such as is shown in the Figure, although any other cross section such as an "I", "T", "O" toll, triangle or flat cross section may be used.

Figure 1B:
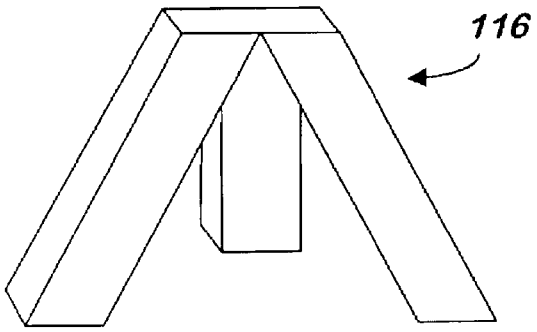
FIG. 1B is a block diagram of a base of the support of FIG. 1A according to one embodiment of the present invention.

In one embodiment, support member 110 is supported by a base 116. Support member 110 may be attached to base using any means such as molding it to the base 116, welding it to the base 116, bolting it to the base 116 or any other means. In another embodiment, base 116 is not used and support member 110 is placed directly on the subfloor and bolted or otherwise attached to the subfloor. If the base is used, the cannel 110 and the base 116 need not be attached to one another, as base 116 may have a slot for insertion of support member 110. Base 116 may be of any shape, such as the tripod shown in FIG. 1B or a flat or box shaped base such as the box shaped base shown in FIG. 1C.

Figure 1C:
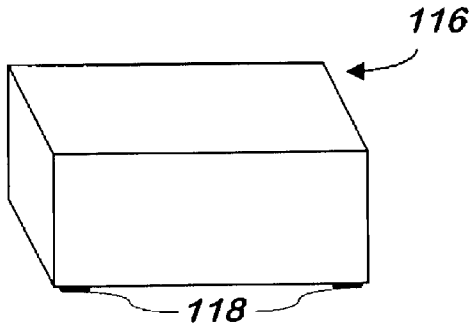
FIG. 1C is a block diagram of a base of the support of FIG. 1A according to another embodiment of the present invention.

In one embodiment, the height of base 116 is adjustable in one or more location at the bottom or other location of base 116, such as four height adjusters 118 of FIG. 1C (only two of which are visible in the Figure). If the height is adjustable in more than one location, the height adjusters 118 may be used to level the support member in the vertical position to accommodate a non level subfloor. One or more height adjusters 118 may also be used to adjust the overall height of the top 114 of support member 110 to allow a plurality of supports 100 to accommodate variances in shape of both the floor and the tool the support 100 will be used to support. Base 116 may be adjustable at other locations other than the bottom. For example, if base 116 is a tripod, the angle and length of each leg may be independently adjustable, for example, using hinges or lockable telescoping legs or both.

The first component described above, the top 114 of support member 110, may support the tool by resting the tool on it in one embodiment, or in another embodiment, the tool may be bolted or otherwise attached to an area of support member 110 at or near the top 114 using any attachment structure such as those described herein. Holes may be drilled into support member 110 at or near the top 114 to accommodate such an attachment means.

Support member 110 contains one or more holes 112 (which may be threaded to allow attachment via a bolt or screw or the bolt or screw may be inserted entirely through support member and a nut used on the other side of support member to tighten the bolt) or other attachment structure that may be used in attachment such as notches or the like to allow the attachment of a ledger plate 120, the second component described above. Ledger plate 120 includes hole 126 or other structure that may be used in attachment with the structure 112. The structures 112 and 126 may allow not only attachment, but can provide adjustability in one embodiment such as by the use of a hole larger than a bolt or screw used for attachment, so that horizontal portion 124 of the ledger plate 120 may be used to support at least an edge of a raised floor at whatever height the raised floor may be.

The two attachment structures 112 and 126 may be used together with a bolt, screw or other structure to complete the attachment capability as described above. This allows adjustment on site without drilling or welding, but then allows the position of ledger plate relative to top 114 to be locked in place. In one embodiment, more than one hole 112 on at least one side of support member 110 are located at heights approximately corresponding to standard heights of a raised floor in a cleanroom, and the heights may take into account the expected height of the base 116, if any. The structures 112, 126 and any other structure used in the attachment may be made to allow adjustment of not only the height but also, optionally, the angle, of the horizontal portion 124. Two holes side by side may replace each of holes 112 and 126 to allow adjustment in multiple dimensions with additional set strength, although a single hole also provides such adjustment.

In one embodiment, the width of horizontal portion 124 of ledger plate 120 may be significantly wider than support member 110 to allow horizontal portion to support more than one section of a raised floor. Ledger plate 120 is shown in the Figure as having the horizontal portion 124 at the bottom, however, the ledger plate 120 may be inverted to allow horizontal portion 124 to be at the top of the ledger plate.

It isn't necessary that the ledger plate 120 have an "L"shape, as any shape of ledger plate may be used as long as it can attach to support member 110 and support a part of a raised floor. It isn't even necessary that horizontal portion 124 extend past the edge of the remainder 112 of the ledger plate 120 as the ledger plate may be made out of a block, with the top of the block being the horizontal portion 124 used to support the at least the edge of the raised floor and the side of the block attached to support member 110.

Figure 2A:
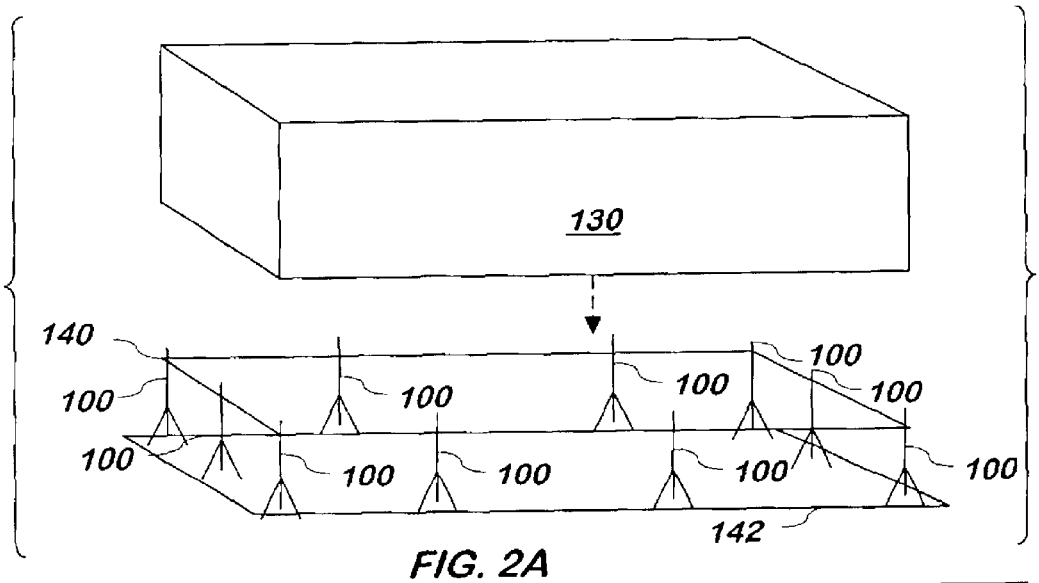
FIG. 2A is a block diagram of a tool about to be lowered onto a group of supports that will support the tool and the edge of a raised floor around a hole approximately the size and shape of the tool according to one embodiment of the present invention.

Referring now to FIGS. 1A and 2A, a plurality of the supports 100 of the present invention are shown placed on a subfloor 142 for supporting a tool 130 above or in a hole 140 in a raised floor. In one embodiment, the hole 140 is approximately the size and shape of the footprint of the tool. Each support 100 may have one or more ledger plates 120 attached to the support member 110. For example, the supports 100 in each corner of the hole may have two ledger plates 120 attached to the support member with the other supports 100 having one ledger plate 120 attached to the support member.

Figure 2B:
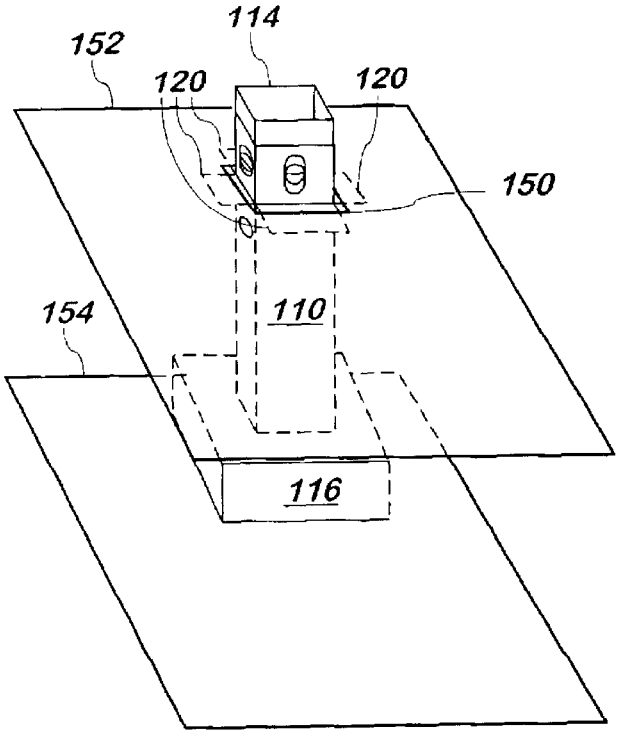
FIG. 2B is a schematic diagram illustrating a support supporting a raised floor having a hole closer to the same size as the cross section of the support at the level of the raised floor than the size of the footprint of the tool, and capable of supporting the tool according to one embodiment of the present invention.

In another embodiment illustrated in FIG. 2B, a small hole 150, closer to the size of the cross section of support member 110 is cut in a section of the raised floor at the location of each support member 110 of the supports 100 placed on a subfloor 154. In such embodiment multiple ledger plates 120 may be attached to a single support member 110 to support the raised floor 152 around the ledger plate. Multiple of the supports 100 may be used to support a single tool as described above with reference to FIG. 2A, however, an individual hole 150 may be precut in the section 152 of the floor surrounding support member 110 of each support 100. The tool would be supported at or near the top 114 of the support 100 as described above, above the subfloor. Some of the other floor tiles under the tool may still be removed to create a hole to provide services to the tool.

According to the present invention, most or all of the weight of the tool 130 is supported by any number of supports 100 and substantially more of the portion of the tool each support 100 is supporting is supported by the support 100 than the area of the raised floor near the support 100. In other words, the tool may be supported by support above the raised floor, or may be touching the raised floor with much less of the weight of the tool 130 being supported by the raised floor than the number of supports 100 supporting the tool 130. This prevents the raised floor from compressing or otherwise being damaged by the weight of the tool. If the tool is above the raised floor, a skirt may be placed under the tool.

In other embodiments, the base of the tool may also sit lower than the raised floor. In such embodiment, the tool may be supported by a portion of the support member 110 that is below the top 114 of the support member, such as via another ledger plate. In one embodiment, the tool is a conventional tool for producing semiconductor, pharmaceutical, biotechnology or food products.

Figure 3:
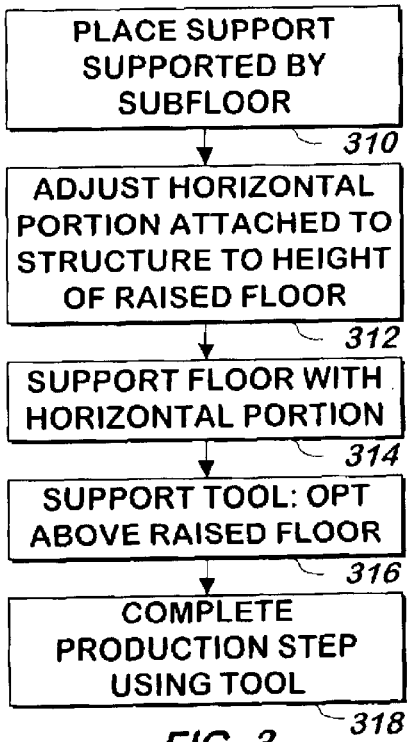
FIG. 3 is a flowchart illustrating a method of supporting a raised floor and a tool according to one embodiment of the present invention.

Referring now to FIG. 3, a method of supporting a tool and a portion of a raised floor is shown according to one embodiment of the present invention. A support is supported 310 by a subfloor, for example on a base supported by the subfloor as described above. A position of a horizontal portion attached to the support is adjusted 312 corresponding to the height of the raised floor as described above using a structure attached to the support that allows adjustment as described above. Step 312 may include locking the horizontal portion, such as by tightening a screw or bolt in place as described above. In one embodiment, step 312 is performed in a clean room without drilling or welding as described above. At least a portion of the raised floor is supported 314 with the horizontal portion adjusted in step 312 as described above. A processing tool is also supported by the support 316, and may sit on or be supported somewhat by the raised floor. Most or all of the weight of the tool is supported by the support and not the raised floor as described above. A product is manufactured 318 using the tool supported in step 316. The product may be a semiconductor, pharmaceutical, biotechnology product or food product. The raised floor may operate as a floor of a cleanroom in one embodiment of the present invention.

What is claimed is:

1. A support comprising:

a first component for supporting a tool; and a second component for supporting a raised floor;

a third component coupled to the first component and second component; and wherein:

at least one selected from the second component and the third component comprises at least a portion of an adjustable attachment structure allowing at least an initial position adjustment of the second component relative to the first component; and most of the weight of the tool is supported by the support and most of the weight of the tool is not supported by the raised floor.

2. The support of claim 1 wherein the first component is located at least near a top of the support.

3. The support of claim 1 wherein the second component is coupled to the first component in a manner that allows a height of a horizontal portion of the second component to be adjusted at least initially.

4. The support of claim 1 wherein the support additionally comprises a base.

5. The support of claim 4 wherein the base comprises at least one structure to allow at least one height adjustment of the base.

6. The support of claim 4 wherein the base comprises a tripod.

7. The support of claim 1 wherein the second component comprises an L-shape.

8. The support of claim 1 wherein the second component comprises a block shape.

9. The support of claim 1 wherein the first component and the second component are coupled via a support member.

10. A method of supporting at least a portion of a tool and at least a portion of a raised floor, the method comprising:

placing a support comprising a first component and a second component so that it is supported by a subfloor;

adjusting a height of the second component so that the second component can support the at least the portion of the raised floor; and causing more of a weight of the at least the portion of the tool to be supported by the first component of the support than the at least the portion of the raised floor.

11. The method of claim 10 wherein the adjusting step comprises locking the second component in place.

* * * * *